US005785846A

United States Patent [19]

Barnes et al.

[11] Patent Number: 5,785,846

[45] Date of Patent: Jul. 28, 1998

[54] VENTURI-POWERED FILTRATION SYSTEM FOR POOLS

[75] Inventors: Steven R. Barnes; Lester Mathews, both of Phoenix, Ariz.

[73] Assignee: Caretaker Systems, Inc., Scottsdale, Ark.

[21] Appl. No.: 835,525

[22] Filed: Feb. 14, 1992

[51] Int. Cl.[6] ..... F04H 4/12

[52] U.S. Cl. ..... 210/169; 210/416.2; 4/490; 4/506; 4/507; 4/509

[58] Field of Search ..... 210/169, 416.2; 15/1.7; 4/490, 506, 507, 509

[56] References Cited

U.S. PATENT DOCUMENTS

| | | | |
|---|---|---|---|
| 2,073,784 | 3/1937 | Day | 210/153 |
| 2,247,116 | 6/1941 | Day | 210/169 |
| 2,725,356 | 11/1955 | Lombardi | 15/1.7 |
| 2,979,733 | 4/1961 | Saint Clair et al. | 210/169 |
| 4,402,094 | 9/1983 | Sanders | 4/504 |
| 4,501,659 | 2/1985 | Henk | 210/169 |
| 4,503,573 | 3/1985 | Handzel | 4/507 |
| 4,519,914 | 5/1985 | Etani | 210/169 |
| 4,627,118 | 12/1986 | Baker | 210/169 |
| 4,818,389 | 4/1989 | Tobias et al. | 210/169 |
| 4,826,591 | 5/1989 | Macia | 210/169 |

*Primary Examiner*—Robert Popovics
*Attorney, Agent, or Firm*—LaValle D. Ptak

[57] ABSTRACT

An improved filtration system for swimming pools and the like is disclosed, in which none of the water passing through the filter passes through the recirculating pump for the swimming pool. This is accomplished by connecting the water inlet of the filter directly with the floor drain and surface skimmer. The outlet from the filter is interconnected with an entrainment nozzle supplied with water under pressure from the recirculating pump for the pool. The pump withdraws water directly from the pool, and supplies that water under pressure to the entrainment nozzle, which then draws water through the filter from the outlet to mix such filtered water with the water supplied by the pump to the entrainment nozzle for return to a return outlet in the pool. As a consequence, water flowing through the filter is drawn through it by means of suction, rather than by supplying the water under pressure. This permits a smaller, lighter-weight filter housing to be used, since no pressurized water is supplied to the filter during normal operation.

14 Claims, 2 Drawing Sheets

FIG. 1
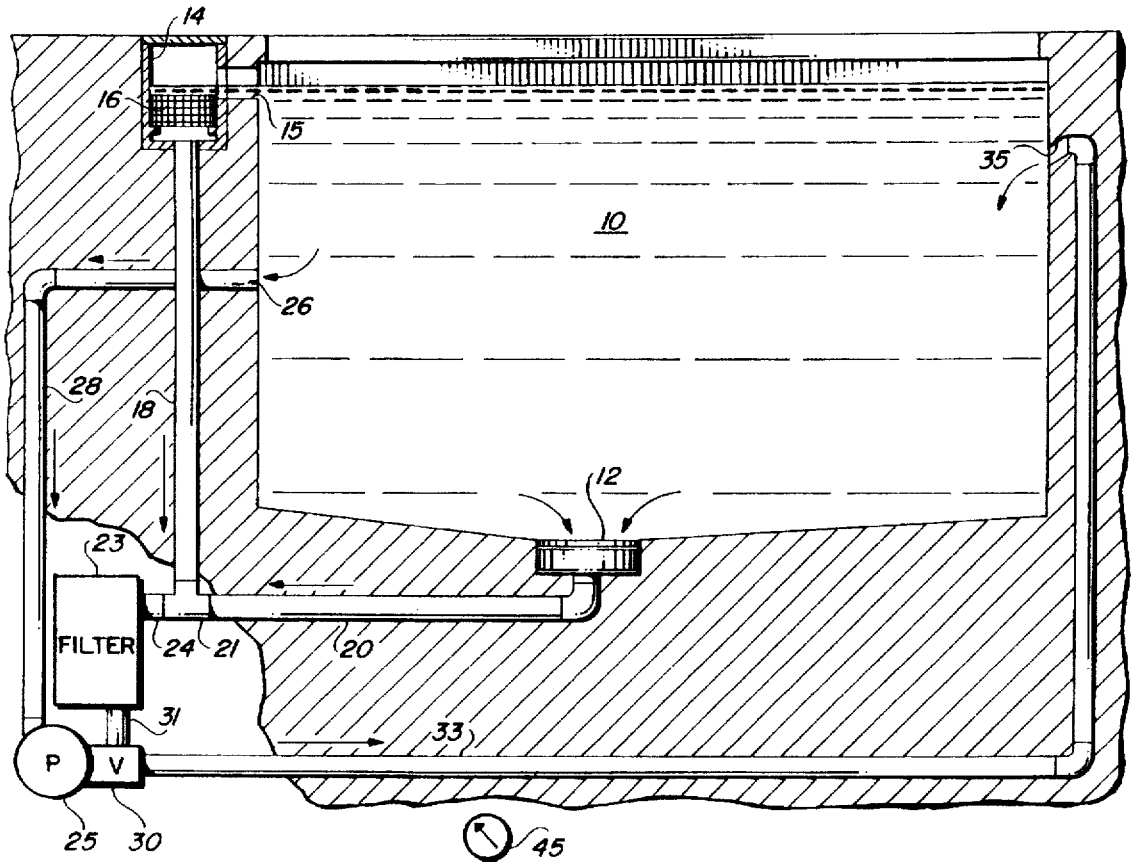
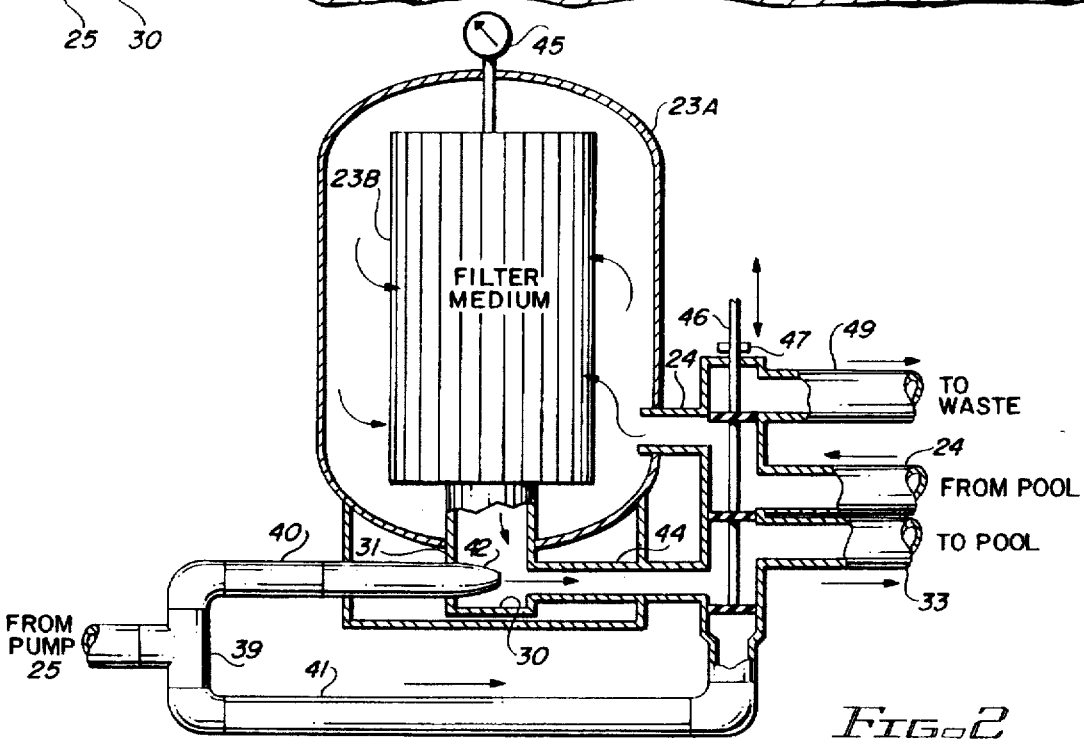
FIG. 2

VENTURI-POWERED FILTRATION SYSTEM FOR POOLS

RELATED APPLICATION

Co-pending application Ser. No. 07/796,069 filed Nov. 20, 1991, now U.S. Pat. No. 5,753,112 and assigned to the same assignee as the present application is related to the subject matter of this application.

BACKGROUND

A major problem which exists with swimming pools and the like, both commercial and residential, is keeping such pools clean and free of dirt and debris. Leaves, bugs, feathers, dust and other items accumulate in the water. If they are not removed, these items cause the water to become cloudy and provide food for algae and the like. Most modern swimming pools employ recirculating pump systems for withdrawing water from drains located at the bottom of the pool and from skimmers located at the water's surface. This water then passes through a filter, which removes suspended particles from the water prior to returning the water to the pool after it has been filtered. Water circulation pumps for achieving this purpose operate for extended periods of time, in some cases continuously, throughout the life of the pool. In addition, in most systems, chemicals such as chlorine are injected into the return water for the pool, either prior to or after filtering of the water has been effected.

Systems also have been developed for causing "automatic" cleaning of pools. The most recent and most effective automatic pool cleaning systems use pop-up cleaning heads in the floor and walls of the pool to eject water under high pressure, in relatively narrow streams, adjacent the pool surface to stir up any dirt and small particles, which otherwise would settle to the bottom or stick to the walls of the pool. This material is placed in suspension, where it is withdrawn through the drain and skimmer by the pump for recirculation through the filter of the recirculation system, as described above. Automatic in-floor pool cleaning systems have reached a highly sophisticated state, and are extremely effective in maintaining pool cleanliness.

Pool recirculating systems of the type described above, whether or not automatic in-floor cleaning systems are employed, all use a pump to withdraw water from a drain and surface skimmer, and to supply that water from the pump, under pressure, to the inlet side of the filter. As the filter continues to remove suspended particles from the water, the passages through the filter tend to become clogged. This results in increasing pressure build-up inside the filter. The higher pressure is reflected back to the pump, placing additional strain on the pump. This results in greater energy consumption and shortens the operating life of the pump motor.

Because substantial pressures can be attained in such standard swimming pool filtration systems, the outer housing for the filter unit must be manufactured with substantial strength. These housings typically are made of steel or fiberglass, and because of the requirements that they withstand significant pressure build-up, they are relatively heavy and bulky.

In the above identified co-pending application, a system is disclosed where a substantial quantity of the water which is withdrawn through the floor drain is supplied through a leaf basket under the control of a venturi or entrainment nozzle connected in the water return of the pump and pool filter system. Thus, at least some of the water, which is withdrawn from the floor drain, does not pass through the pump and filter, but instead is recirculated under the control of a venturi nozzle.

In-floor pool cleaning systems inherently do not have a capability of efficiently handling leaves and the like. As a result, a conventional leaf skimmer continues to be a necessary part of most pool systems. Leaf skimmers typically are located in a wall or cavity adjacent the pool, and have an inlet, which is partially submerged and partly above the normal water level of the pool. The inlet has a one-way pivoted floating dam in it to permit water and leaves to pass into the leaf skimmer; but the dam prevents leaves and other debris from passing out of the skimmer and back into the pool. In conventional pool systems, the surface water is caused to move from the pool into the skimmer by withdrawing at least a portion of the water for recirculation and filtering from the bottom of the skimmer, in addition to water withdrawn from the drain in the bottom of the pool. Water from both the skimmer and the drain then flows through the recirculating pump and filter on a continuous basis.

Leaves and other debris, which are pulled into the leaf basket, tend to plug up the openings in the basket and restrict the water flow through it. Thus, it is necessary, periodically, to empty the leaf basket to prevent substantial restriction of the water flow through it. This is particularly important if part of the recirculation water flow for the pool necessarily is withdrawn from the bottom of the cavity in which the leaf basket is located. To prevent this restriction in the recirculating water flow of a swimming pool, a pool skimmer which does not require the flow through a leaf basket to also pass through the circulation system has been developed. This skimmer is shown in the patent to Macia U.S. Pat. No. 4,826,591.

The Macia system does not pull any of the water, for recirculation through the pool filter, through the leaf basket. Instead, water, which is recirculating in the pool from the return line of the water recirculation system, is discharged into an entrainment or venturi nozzle located beneath the basket in the skimmer. This entrainment nozzle then pulls additional water through the basket from the top of the pool to mix with the water returned from the water recirculation return to produce circulation of water from the surface of the pool into the basket, and then back out into the pool. If the basket becomes clogged with leaves, however, no diminishment of the recirculation water flow takes place, since that water flow is not dependent upon the water which passes through the leaf basket. In the Macia system, the recirculation water flow is obtained from the floor drain of the pool. This constitutes a substantial improvement in swimming pool skimmers, and also minimizes the possibility of damage to the pump whenever the skimmer becomes clogged.

The system of Macia, however, even when it is used in conjunction with a swimming pool recirculation system, does not in any way affect the potential damage to the pump which can occur from a clogged filter in the filtration system of the pool, since the pump still supplies water under pressure to the standard pool filter. The water passing through the filter then is used as the water supply for the entrainment nozzle in the skimmer.

Another patent, to Day U.S. Pat. No. 2,247,116, is directed to a venturi return pool system, with supplemental inlets located about the periphery of the pool, for mixing recirculated and treated water from the pool with untreated water drawn from a different part of the pool than from which the recirculated water was drawn. This is intended to improve the circulation of water in the pool, and to facilitate the mixing of treated water with untreated water to increase the effectiveness of the chemical treatment of the water. This patent, however, does not deal with the problem of clogged filters and the pressure build-up which occurs. In fact, in the device of the Day patent, any debris which is drawn into the main drain of the pool passes into the recirculating pump/filter system of the pool and must be removed in a conventional manner. If such debris is not removed, constriction of the water flow through the recirculation path occurs, and possible damage to the pump and/or filter can result.

It is desirable to provide an improved system for filtering the water in a swimming pool, in which none of the water passing through the filter is required to pass through the recirculating pump for the pool.

SUMMARY OF THE INVENTION

Accordingly, it is an object of this invention to provide an improved swimming pool filtration system.

It is another object of this invention to provide an improved low pressure pool filtration system.

It is an additional object of this invention to provide an improved system for filtering the water for recirculation in a pool system, which provides a venturi or entrainment system for moving water through the filter without passing that water through the pump used to recirculate water in the pool.

In accordance with a preferred embodiment of the invention, an improved filtration system for pools includes a filter having a housing with a water inlet and water outlet. The water inlet is coupled with the water of the pool to be filtered. A recirculating pump is used to supply water under pressure to an entrainment nozzle coupled with the water outlet of the filter to move water from the pool through the filter, and out of the filter to combine with the water supplied from the pump in the entrainment nozzle. The output of the entrainment nozzle then is coupled to receive the water from the filter and the pump for return of the water to the pool.

BRIEF DESCRIPTION OF THE DRAWINGS

FIG. 1 is a diagrammatic cross-sectional view of a preferred embodiment of the invention;

FIG. 2 is a cross-sectional view of a portion of the embodiment shown in FIG. 1;

DETAILED DESCRIPTION

Figure 3:
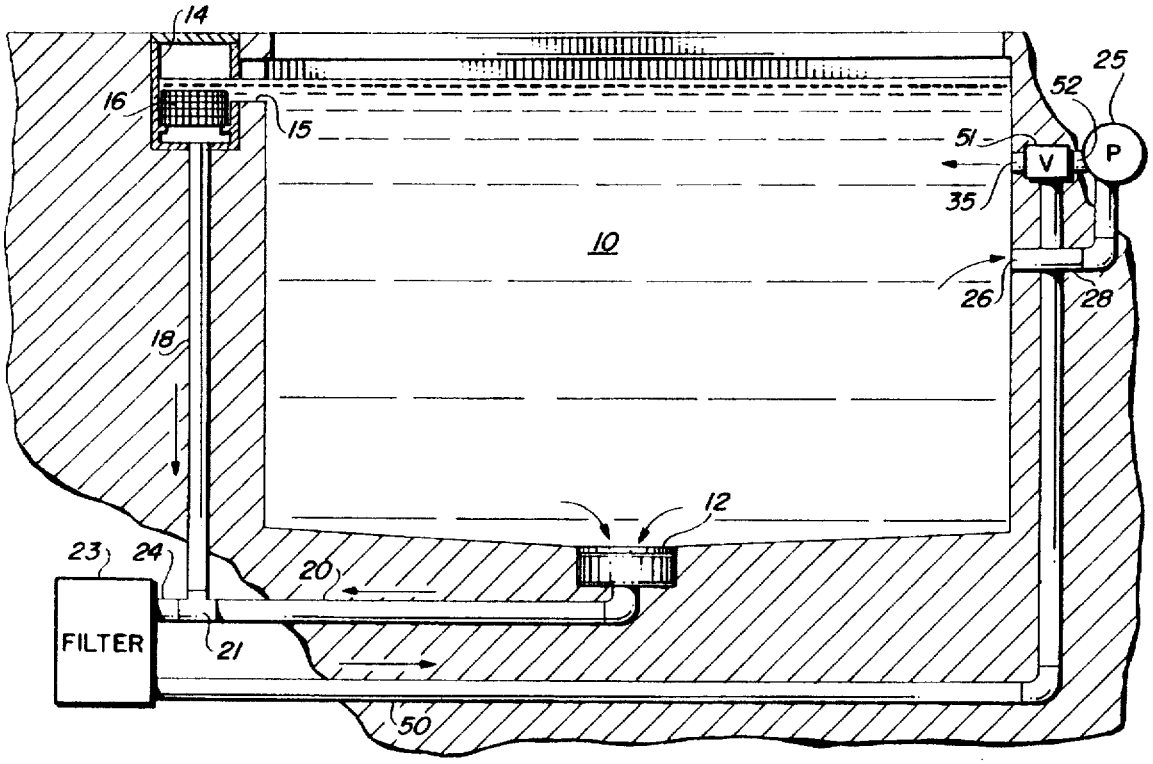
FIG. 3 is a diagrammatic cross-sectional view of another embodiment of the invention.

Reference now should be made to the drawings, in which the same reference numbers are used throughout the different figures to designate the same or similar components.

FIG. 1 shows a typical swimming pool 10 in cross section across its width. This pool includes a drain 12, located in the bottom of the pool, and a surface skimmer or leaf skimmer 14 located adjacent the side of the pool. The skimmer 14 communicates by way of a passageway 15 with the water in the pool. The level of the water in the pool 10 typically is above the lower edge of the passageway 15; so that water from the pool flows into and communicates directly with the skimmer 14. A conventional skimmer basket 16 is located in the skimmer, and is situated so that water flowing through the passageway 15 flows downwardly through the basket 16 into a pipe 19 connected to one leg of a connecting T 21. Water flowing into the drain 12 also flows through a pipe 20 connected to another leg of the T 21.

The output of the T 21 is connected to a pipe 24, which comprises the inlet pipe to a filter 23, located to remove suspended particles from the water flowing to it from the pipes 18 and 20. After filtration, water flows out of the filter 23 through a pipe 31 into a venturi 30, from which the water returns back into the pool 10 by way of a pipe 33 to a return nozzle 35. It is important to note that no pump is located in the water circulation path through the filter 23.

A pump 25 for recirculating water in the pool 10, and for controlling the water flow through the filter 23, is connected to a separate water inlet 26 (illustrated as located approximately half-way up the side of the pool 10), which is connected to the pump 25 by means of a supply pipe 28. The output of the pump 25 is supplied to the venturi 30; so that the water circulated by the pump 25 completely bypasses the floor drain 12, the skimmer 14, and the filter 23.

FIG. 2 illustrates the details of the manner in which the water from the pumps is discharged under pressure into the venturi 30 to pull or draw water through a vacuum-like action, from the pool through the pipe 24 into the filter 23. FIG. 2 is a cross-sectional view of the filter construction and the plumbing interconnections which permit location of the pump 25 outside of the recirculation path, including the filter 23. The filter 23 is illustrated as having an outer housing 23A, with a conventional filter medium 23B located in it. The filter medium 23B may be of any conventional type, such as diatomaceous earth or other suitable filter materials.

The normal operating arrangement for the apparatus in a recirculating pool system is illustrated in FIG. 2. A pipe 40 supplies water to an entrainment nozzle 42 located in the venturi chamber 30 to discharge into an outlet pipe 44. All of this is located in the base of the filter housing 23A, as illustrated. The nozzle 42 entrains water flowing downwardly out of the filter medium through the pipe 31, and mixes that water with the water from the nozzle 42 to discharge into the pipe 44. The pipe 44 typically is larger in diameter than the diameter of the nozzle 42; so that substantial quantities of water are pulled downwardly or sucked downwardly under a vacuum effect through the pipe 31 to cause a flow of water to take place from the drain 12 and the skimmer 14 into the pipe 24 constituting the inlet to the housing 23A of the filter.

As shown in FIG. 2, a push-pull valve 46 is located in its lower position, which is the recirculating and filtering position for the apparatus. Consequently, water discharged through the pipe 44 continues its path through the pipe 33 and back to the pool, as described above.

Whenever a backwash of the filter medium 23B is desired, the operating rod of the valve 46 is pulled upwardly to move the stop 47 up until the upper valve member of the three shown in FIG. 2 is seated on the upper side of the push-pull valve housing. When this occurs, the pipes 24 and 33 are closed off from communication with either of the pipes 24 and 44 in the filter mechanism. The pipe 24 then is interconnected with a waste discharge pipe 49. At the lower end of the apparatus, an additional input pipe 41 then is connected from the pump 25 in parallel with the pipe 40 to direct water into the venturi chamber 30; so that water from the pump 25 flows upwardly through the pipe 31, reversing the normal water flow through the filter. The backwash water then flows outwardly through the pipes 24 and 49 to be discharged as waste.

The determination as to when to effect such backwashing typically is determined by means of a vacuum gauge 45 located in the top of the tank 23A, which measures the amount of pull or vacuum being exerted on the water withdrawn through the filter medium 23B. If the filter becomes substantially clogged, the reading on the vacuum meter 45 increases. It is to be noted, however, that this vacuum meter 45 contrasts with the standard pressure meter typically located in a similar position in conventional pool filters. No water under pressure ever enters into the housing 23A; so the housing can be made of substantially lighter and thinner materials than are usually employed for pool filters which undergo significant pressures.

Reference now should be made to FIG. 3, which illustrates another variation of the invention. The pool 10 again is shown in cross section in FIG. 3; and the interconnections to the input to the filter 23 from the drain 12 and the skimmer 14 are the same as shown in FIG. 1. In FIG. 3, however, the output side of the filter is connected directly through a pipe 50 to a venturi 51, located directly adjacent the return nozzle 35, which supplies the return water into the pool 10. The pump 25 is located, as in FIG. 1, in a recirculating loop which is independent of, or could be considered to be in parallel with, the recirculating loop through the filter 23. The pump 25 draws water from the pool through an inlet nozzle 26 and a pipe 28, as explained above in conjunction with FIG. 1. The discharge of the pump 25 is through a pipe 52 into a venturi chamber, which creates significant suction to pull water through the pipe 50 (and, therefore, through the filter 23) to effect the filtration and recirculation of water through the drain 12 and the skimmer 14.

Figure 4:
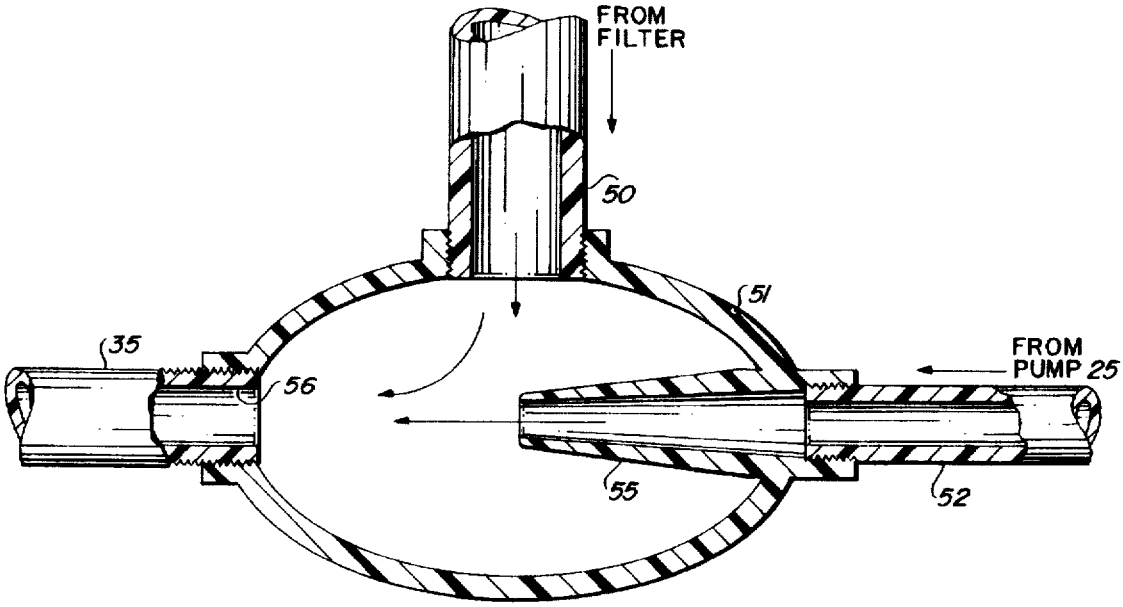
FIG. 4 is a detail of the embodiment shown in FIG. 3.

FIG. 4 is a detail of the venturi 51, which is used in the apparatus of FIG. 3. As illustrated, the pipe 52, which supplies water to the venturi chamber, supplies that water through a narrowed entrainment nozzle 55 directed toward an outlet 56, into which the water return 35 is connected. The pipe 50 is connected into the top of the venturi chamber 51; so that significant suction and substantial water flow from the filter 23 takes place in the pipe 50 when the water under pressure rapidly moves from the end of the entrainment nozzle 55 into the opening 56 communicating with the return 35. The operation of the device shown in FIGS. 3 and 4 is the same as the device shown in FIGS. 1 and 2, with the exception that the venturi/entrainment apparatus is located at a remote distance from or external of the filter 23 in the embodiment of FIGS. 3 and 4; whereas in the embodiments of FIGS. 1 and 2, this apparatus is located directly beneath the outlet pipe from the filter. Additional provisions, not shown, need to be made with the apparatus of FIG. 3 to effect backwashing of the filter 23.

It is to be noted that the invention, which has been described above in conjunction with the two different embodiments illustrated in the drawings, operates so that the pump 25 is in an independent recirculation path from the filter at all times during the filtration operation of the system. Consequently, no stress is placed on the pump 25 as a result of clogging of the filter 23 or a malfunction of the filter. The filter 23 could be completely blocked, as well as the drain 12 and the skimmer 14, and the pump 25 would continue to operate to recirculate the pool water.

In the system shown in both FIGS. 1 and 3, the addition of chemicals for maintaining a chemical balance of the water in the pool 10, ideally takes place in the loop which passes through the pump 25. It also should be noted that the return 35 is representative only, and that multiple returns, such as in-floor cleaning heads and the like, may be used in the system without affecting the underlying operation which has been described above.

The foregoing description of the preferred embodiments of the invention should be considered as illustrative, and not as limiting. Various changes and modifications will occur to those skilled in the art, without departing from the true scope of the invention as defined in the appended claims.

We claim:

1. An improved filtration system for a pool having at least two points of suction therein including in combination:

a filter having a housing with a water inlet and a water outlet;

pipes coupling the water inlet of said filter with said two points of suction in said pool;

a water supply independent of said two points of suction for supplying water under pressure;

an entrainment nozzle coupled to receive water from said water supply and further coupled to receive water from the water outlet of said filter for moving water from said two points of suction through the water inlet of said filter and said filter to the water outlet thereof; and a return pipe coupled to receive water from said entrainment nozzle and said water outlet of said filter for returning said water to said pool.

2. The combination according to claim 1 wherein said water supplied to said entrainment nozzle comprises recirculated water from a return line of a pool water recirculation system which is separate from said pipes coupling said two points of suction with the water inlet of said filter.

3. The combination according to claim 2 wherein said water supply for supplying water under pressure comprises a recirculating pump having a water inlet and a water outlet, with the water inlet of said pump coupled to receive water from said pool, and the water outlet of said pump coupled with said entrainment nozzle so that water passing through said filter does not pass through said pump.

4. The combination according to claim 3 wherein said entrainment nozzle is located adjacent to said filter housing.

5. The combination according to claim 4 wherein said two points of suction comprise a floor drain and a surface skimmer coupled together for supplying pool water to be filtered to said water inlet of said filter.

6. The combination according to claim 4 further including a normally-closed waste outlet coupled with the water inlet to said filter; and a valve for opening said waste outlet, for closing said pipe for returning water to said pool and for closing said pipes coupling the water inlet of said filter with said two points of suction, such that water from said entrainment nozzle passes in a reverse direction through the water outlet of said filter to the water inlet thereof and to said waste outlet to backwash said filter.

7. The combination according to claim 3 wherein said entrainment nozzle is located at a position external of said filter housing, adjacent said return pipe where water is returned to said pool.

8. The combination according to claim 7 wherein said two points of suction comprise a floor drain and a surface skimmer coupled together for supplying pool water to be filtered to said water inlet of said filter.

9. The combination according to claim 1 further including a normally-closed waste outlet coupled with the water inlet to said filter; and a valve for opening said waste outlet, for closing said pipe for returning water to said pool and for closing said pipes coupling the water inlet of said filter with said two points of suction, such that water from said entrainment nozzle passes in a reverse direction through the water outlet of said filter to the water inlet thereof and to said waste outlet to backwash said filter.

10. The combination according to claim 1 wherein said water supply for supplying water under pressure comprises a recirculating pump having a water inlet and a water outlet, with the water inlet of said pump coupled to receive water from said pool, and the water outlet of said pump coupled with said entrainment nozzle; so that water passing through said filter does not pass through said pump.

11. The combination according to claim 10 wherein said entrainment nozzle is located in adjacent to said filter housing.

12. The combination according to claim 10 wherein said entrainment nozzle is located at a position external of said filter housing, adjacent said return pipe where water is returned to said pool.

13. The combination according to claim 1 wherein said two points of suction comprise a floor drain and a surface skimmer coupled together for supplying pool water to be filtered to said water inlet of said filter.

14. The combination according to claim 13 wherein said water supply for supplying water under pressure comprises a recirculating pump having a water inlet and a water outlet, with the water inlet of said pump coupled to receive water from said pool, and the water outlet of said pump coupled with said entrainment nozzle; so that water passing through said filter does not pass through said pump.

* * * * *